United States Patent [19]

Friedman

[11] Patent Number: 4,642,926

[45] Date of Patent: Feb. 17, 1987

[54] KNOCK-DOWN EXHIBITION PANEL ASSEMBLY

[75] Inventor: Arthur L. Friedman, Philadelphia, Pa.

[73] Assignee: General Exhibits, Philadelphia, Pa.

[21] Appl. No.: 551,962

[22] Filed: Nov. 15, 1983

[51] Int. Cl.[4] ..... G09F 7/00

[52] U.S. Cl. ..... 40/605; 40/606; 40/607

[58] Field of Search ..... 40/605, 606, 607; 52/732, 243, 238.1, 248.1

[56] References Cited

U.S. PATENT DOCUMENTS

| | | | |
|---|---|---|---|
| 2,596,582 | 5/1952 | Michel | 40/607 |
| 2,631,392 | 3/1953 | Stevenson | 40/607 |
| 2,952,057 | 9/1960 | Lassiter | 40/607 |
| 3,958,351 | 5/1976 | Summey | 40/607 |
| 4,209,922 | 7/1980 | Porreca | 40/606 |

*Primary Examiner*—Gene Mancene
*Assistant Examiner*—Wenceslao J. Contreras
*Attorney, Agent, or Firm*—Louis Weinstein

[57] ABSTRACT

A panel system for exhibits comprises a plurality of upright rigid supporting members with generally planar members releasably connected on opposite sides to two adjacent supporting members. Each panel has an intermediate portion and along the two opposed edges are respective flange portions extending in opposite directions from said intermediate portion. This panel configuration enables the panels to be stacked in nesting fashion. Also provided are easily demountable header and lighting fixture subassemblies adapted to be affixed to the rigid members. Means are provided for detachably supporting horizontal rigid members upon the vertical rigid members and in other combinations as well.

17 Claims, 23 Drawing Figures

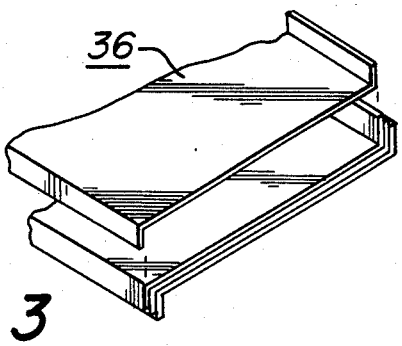
FIG. 3
FIG. 4
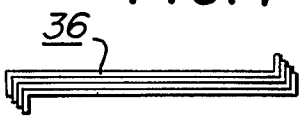
FIG. 5
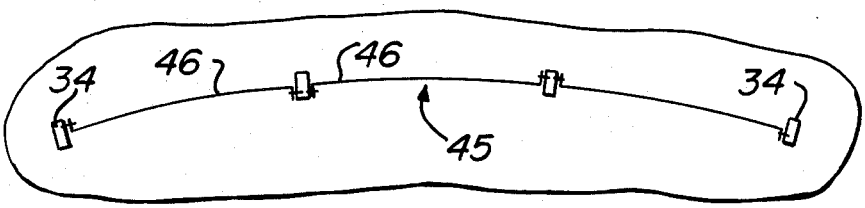
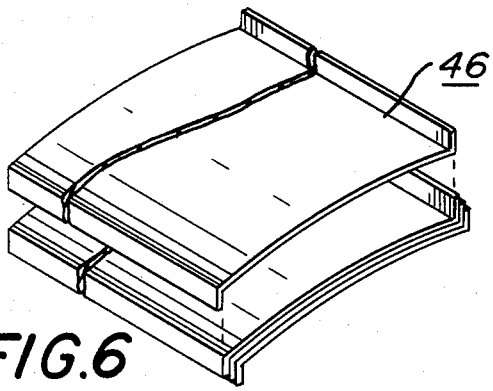
FIG. 6
FIG. 7
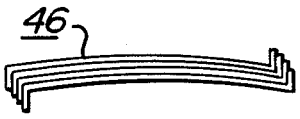

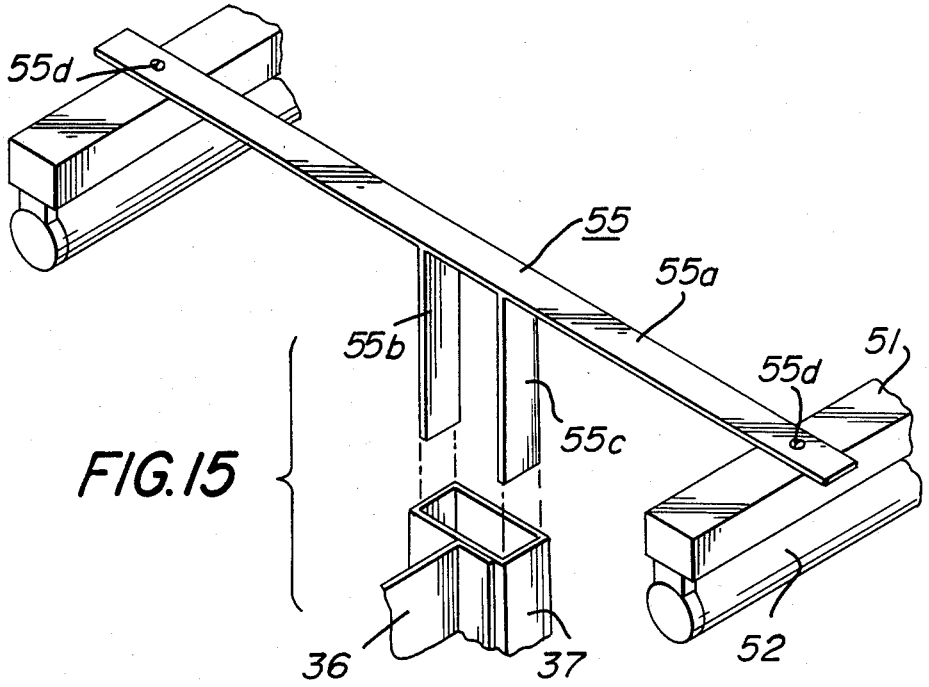
FIG.15
FIG.16
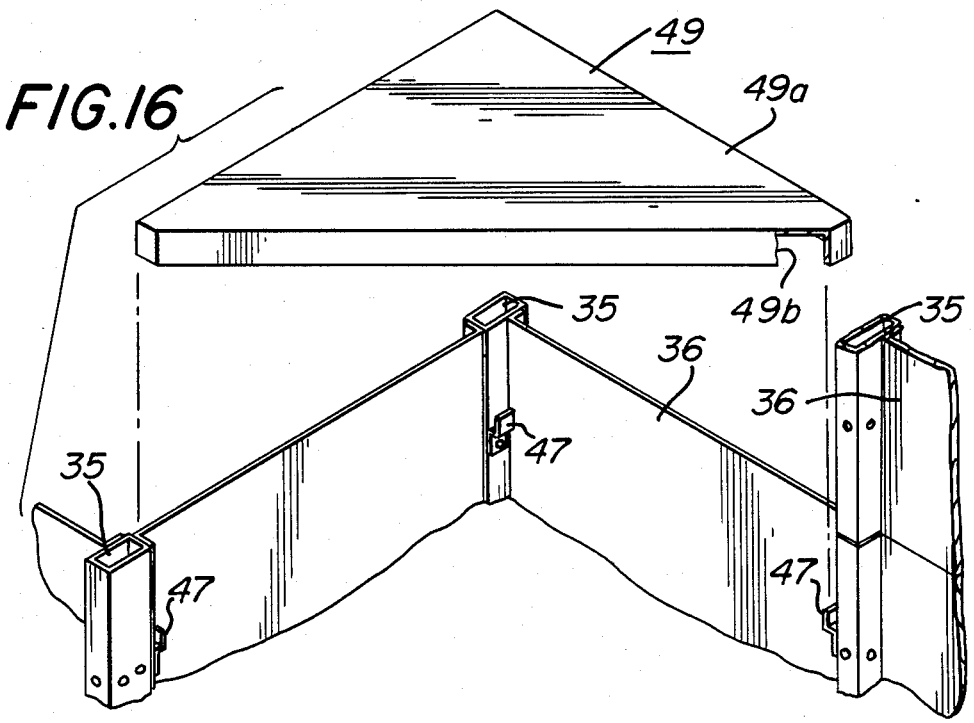

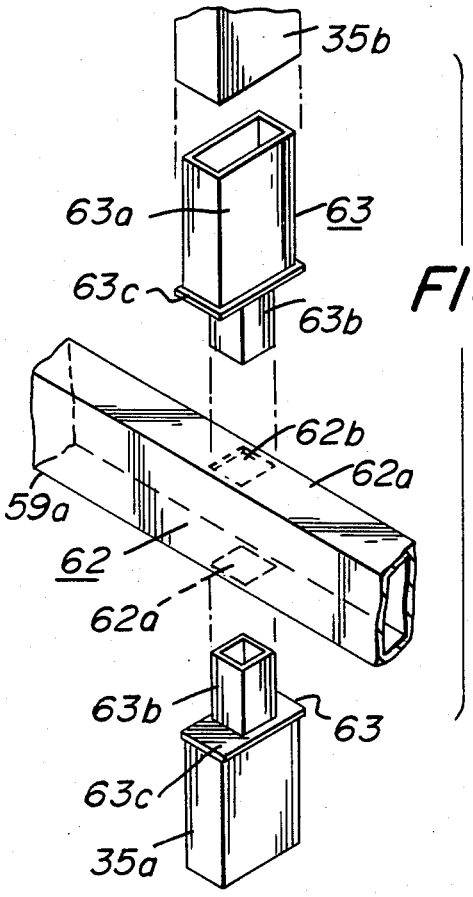
FIG.20
FIG.21
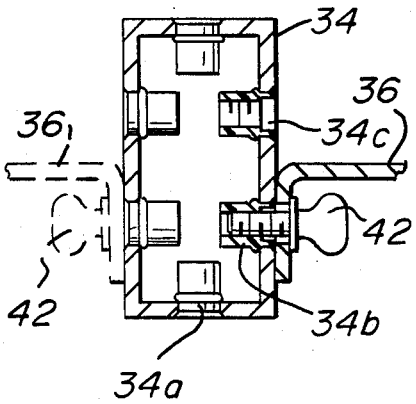
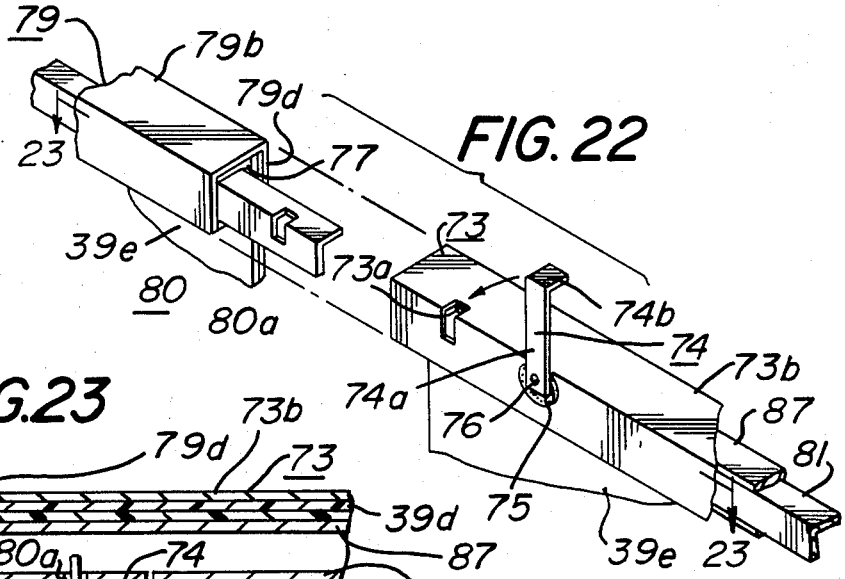
FIG. 22
FIG.23
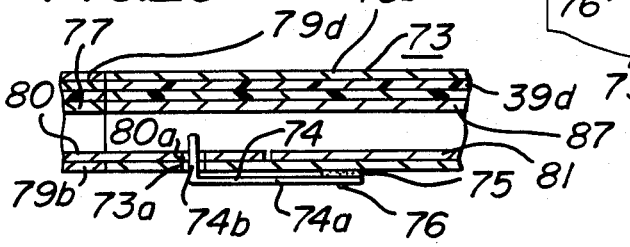

KNOCK-DOWN EXHIBITION PANEL ASSEMBLY

BACKGROUND OF THE INVENTION

A. Field of the Invention

This invention relates to panel structures and, in particular, to panel structures which are easily assembled or disassembled and can be shipped in compact packages.

B. Prior Art

Structures for exhibitions at trade shows or conventions and the like are known which comprise a plurality of upright support members between which a number of panels are mounted for easy assembly or disassembly by means of screws or equivalent fastening means. As there are many such shows in different places, it is highly advantageous that these structures be easily and inexpensively shipped from one place to another. In these known structures, the panels often were made so that, viewed end-on, they had a generally C-shaped outline. When it was desired to ship the structure in unsassembled form, the bulk or volume occupied by the various component parts such as the panels was considerably larger than desired and difficult to pack in such a way as to conform with the shipping regulations of parcel delivery services, trucking companies and other common carriers. Often, the bulk of the overall package was such that unnecessarily high shipping charges were incurred.

One of the main reasons why the crates or packages were unnecessarily large was the fact that the panels themselves could not be nested, i.e., one would not fit in or otherwise closely contact another.

It is therefore among the objects of this invention to provide:

(a) A structural panel system for exhibit purposes and the like which can be packaged within a relatively small volume for shipping purposes.

(b) A panel exhibition system having nestable panels.

(c) A panel exhibition system which is easily assembled or disasembled and easily arrangeable into many different configurations for various display purposes.

(d) Other advantages which will appear hereafter.

SUMMARY OF THE INVENTION

A panel display system comprises at least two rigid supporting members between which two opposing edge portions of a generally planar member are fixed. The edge portions are flanges which extend in mutually opposite directions from the intermediate portion of the planar member thereby enabling the panel members to be easily stacked in nesting position when demounted from the supporting members.

BRIEF DESCRIPTION OF THE DRAWINGS

FIG. 3 is a fragmentary, isometric view of a number of the panels according to the present invention;

FIG. 4 is an end view of a stack of nesting panels constructed in accordance with the present invention;

FIG. 5 shows curved panels made in accordance with another embodiment of the present invention;

FIG. 6 is a fragmentary, isometric view of a number of the panels shown in FIG. 5;

FIG. 7 is an end view of a stack of nesting panels of the type shown in FIG. 5;

FIG. 15 is a fragmentary isometric view of a modified component that may be incorporated in the apparatus shown in FIG. 1;

FIG. 16 is an enlarged fragmentary, partly sectional view, of a detail of the apparatus shown in FIG. 1;

FIG. 20 is an exploded, partly sectional, fragmentary view of a modification of the assembly shown in FIG. 1;

FIG. 21 is a sectional view of a detail of the assembly shown in FIG. 2 taken along section line 21—21;

FIG. 22 is an exploded fragmentary, broken-away view of an alternate embodiment of the header assembly shown in FIG. 1; and FIG. 23 is a sectional view taken along the section line 23—23 of FIG. 22 in the direction indicated.

DETAILED DESCRIPTION OF THE DRAWINGS

Figure 1:
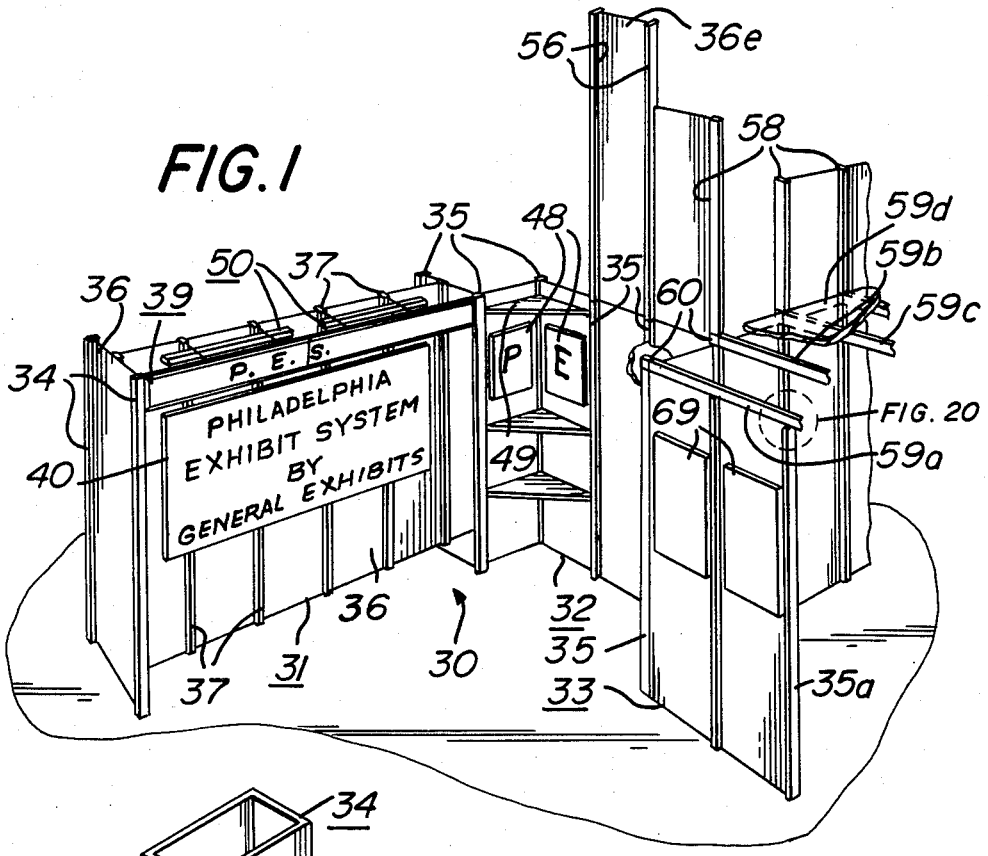
FIG. 1 is an isometric view of an overall system employing panels for exhibit purposes which embodies the present invention.
Figure 2:
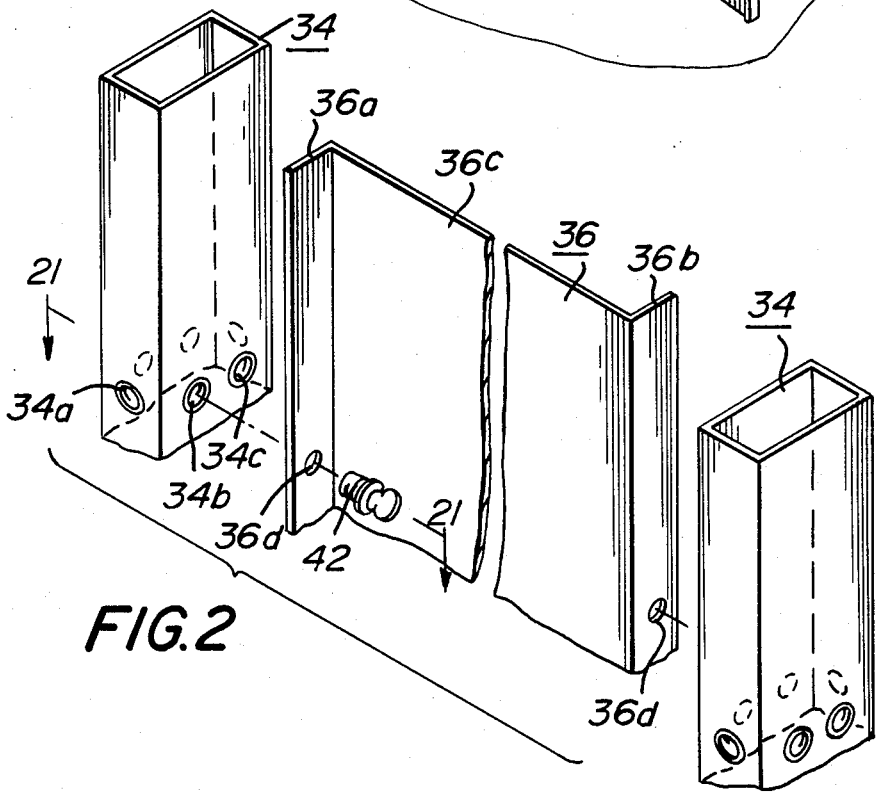
FIG. 2 is an exploded view of the novel panel subassembly.
Figure 8:
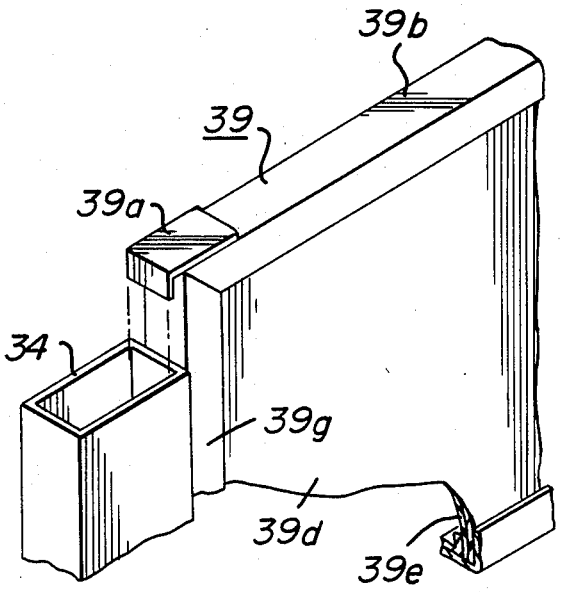
FIG. 8 is an enlarged fragmentary, isometric view of the header subassembly, one of the elements shown in the overall assembly of FIG. 1.

FIG. 1 shows a panel exhibition system or assembly generally at the numeral 30 which employs the particular basic panel unit in accordance with the present invention. The system 30 comprises a first section indicated generally at the numeral 31, a corner section 32 and a third section 33 at right angles to the first section 31. All three sections incorporate the basic panel unit comprising a first rigid, generally rectilinear support member, a generally Z-shaped panel and, in most cases, another rigid support member, the panel being connected to the support members on opposite edges thereof. This basic subassembly is shown in FIG. 2.

First section 31 has a first pair of upright support members 34 on one end and a second pair 35 at the other, each pair also having a Z-shaped panel 36 fixed intermediate them. The left pair 34 are as shown in FIG. 2 wherein the intermediate, Z-shaped panel 36 is fastened to the uprights 34 by means of thumb screws 42 which pass through an aperture **36*d* in the flange 36*a* and threadedly engage an internally-threaded metal or plastic member 34*b* disposed within an aligned aperture in the left (back) upright 34. The other inserts 34*a* and 34*c* are provided for possible additional thumb screws in the flange 36***a* in other areas to enable flexibility in fixing the left flange 36*a* to the upright rigid member 34. In the form shown in FIG. 2, flange 36*a* is fastened to the larger side of the member 34; the provision of insert 34*a* in it allows the smaller side of member 34 to be alternatively affixed to flange 36*a* if desired. The construction of the right support portion of the basic unit is also shown in FIG. 2 and is substantially identical to the construction on the left side. In it flange 66 is disposed on the other side of panel 36 with an aperture 36*d* corresponding to aperture 36*d* in the left flange.

Between the two described end subassemblies of section 31, there are disposed a plurality of panels 36 coupled to one another between upright rigid members 37 in the same way as between uprights 34, 35, the whole series being disposed at right angles to the end subassemblies.

FIGS. 3 and 4 show how the panels 36 may easily be stacked for storage or shipment in nesting fashion, this being impossible with panels having a conventional substantially C-shaped end profile. By making them nestable, the elements of the overall assembly 30 can be much more compactly arranged for shipment when knocked-down. This saves on shipping costs and also provides a less bulky package.

The intermediate portion between the flanges of each Z-sectioned unit need not be exactly flat but, alternatively, it may be somewhat curved such as shown in FIGS. 6 and 7 at the numeral 46. FIGS. 6 and 7 demonstrate that they are still nestable even when a slight curve is imparted to them. In the subassembly arrangement of FIG. 5, adjacent ones of the panels 46 in the structure 45 are mounted oppositely, but they could just as well be mounted in exactly the same way or in some desired combination of both. See FIG. 21.

Figure 9:
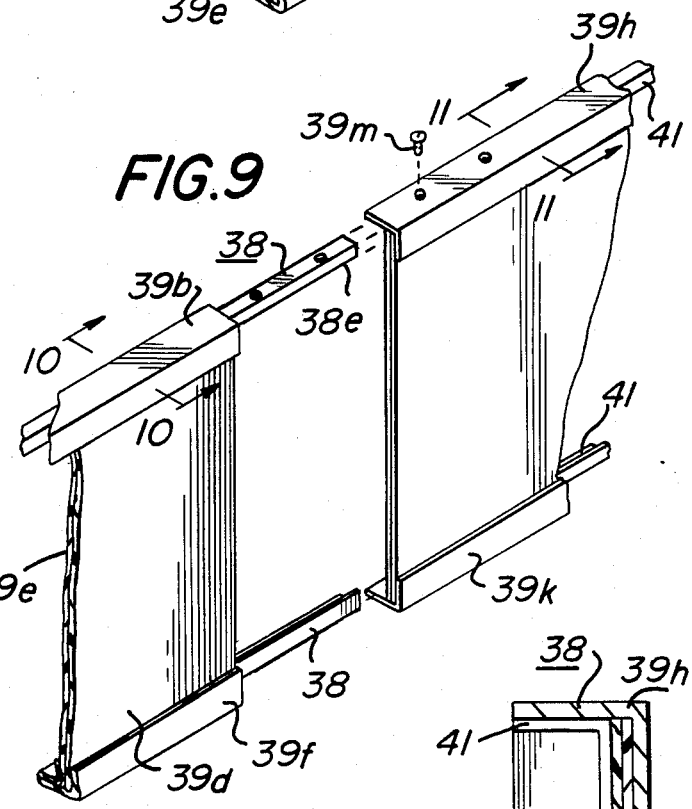
FIG. 9 is a fragmentary, partly sectional and isometric view of a detail of the header subassembly shown in FIG. 1.
Figure 10:
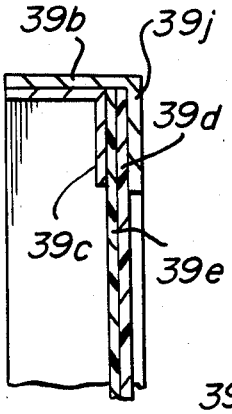
FIG. 10 is a fragmentary, sectional view of the apparatus shown in FIG. 9 taken along the section line 10—10 thereof.
Figure 11:
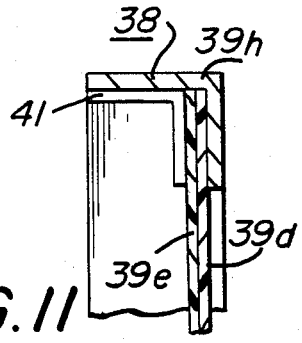
FIG. 11 is a fragmentary sectional view of the apparatus shown in FIG. 9 taken along the section line 11—11.
Figure 12:
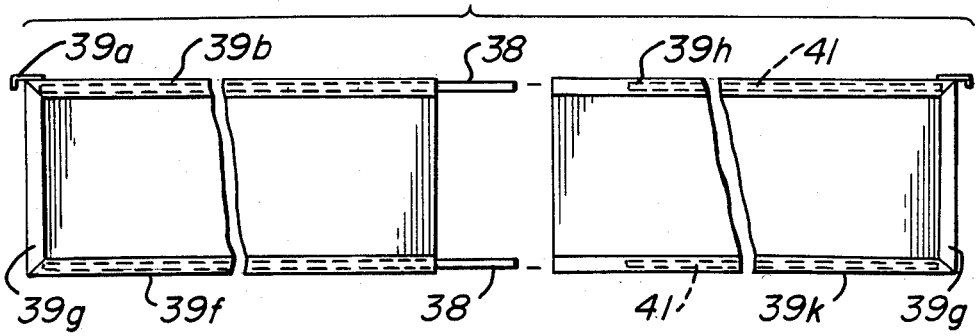
FIG. 12 is an enlarged fragmentary, side elevation view of the header subassembly shown in FIG. 1.

Returning to FIG. 1 and looking at FIGS. 8, 9, 10, 11 and 12, a header indicated generally at 39 is shown. This comprises mating, two-part upper frame members 39*b*, 39*h* in parallel with the identical mating, two-part lower frame members 39*f*, 39*k* and two unitary opposite side members 39*g*, only the left one being shown in FIG. 8. The left upper and lower frame parts 39*b* and 39*f* each have a substantially L-shaped cross-section. Part 39*b* is screwed to another L-sectioned inner rigid member 38 by screws 39*m* which engage holes 38*e*. The vertical leg of member 38 is made to be spaced from the corresponding vertical leg of member 39*b* to accommodate the insertion between them of the edges of an outer clear plastic or glass pane or sheet 39*d* as well as an inner contiguous sheet or pane of opaque plastic or glass 39*e*. The inner member 38, after having been screwed together with upper frame member 39*b*, has a part protruding as shown in FIG. 9. It is slid axially with respect to members 39*h* and 39*k* so that the vertical leg of member 38 slides behind the upper and lower edge portions of the member 39*e*. Thereupon it may be fixed to the members 39*h*, 39*k* by screws 39*m* which pass through apertures in the horizontal portions of members 39*h* and 39*k*. Of course, if the length of the header 39 is not as great as shown, its two-part, end-to-end construction may be replaced by a unitary type. Desired indicia such as letters or numerals, as shown, may be printed on the outer sheet 39*d* and both it and inner pane 39*e* may be illuminated by lighting apparatus 50 as shown in FIG. 14 or FIG. 15.

To facilitate removal of the header and its inserted clear and opaque sheets from the entire structure 30, the entire header subassembly may be lifted out from end members 34 and 35. The header is suspended from the section 31 by means of hanger elements 39*a* attached to upper frame sections 39*b* and 39*h* at each end. Those hangers have a generally L-shaped cross-section with their longer leg portions welded, screwed, or otherwise affixed to the top corner surfaces of the upper frame elements, and their shorter, vertical legs, which are spaced from the vertical sides of the side members 39*g*, are dimensioned to fit snugly into the upper open ends of rigid vertical members 34 and 35.

If desired, signs such as the sign 40 may be affixed in any known fashion to the upright rigid members 37 in section 31. Alternatively, physical exhibits may be suspended from them or from peg or hook boards attached to them.

Figure 14:
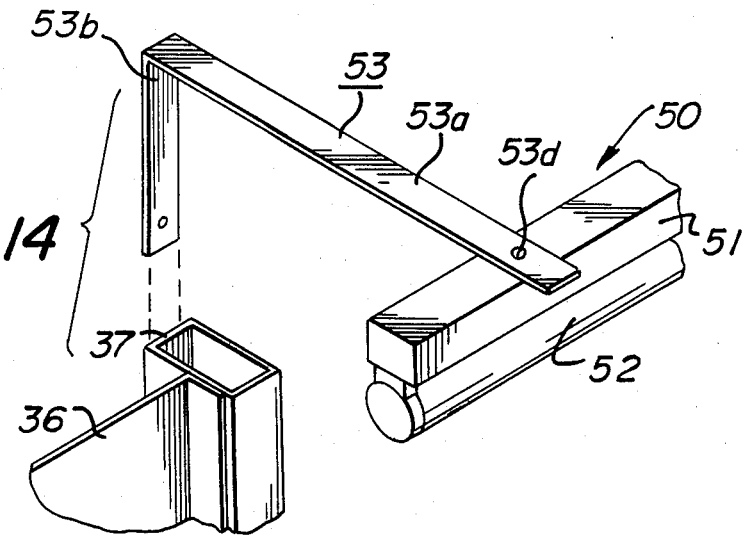
FIG. 14 is an enlarged fragmentary isometric view of another detail of the apparatus shown in FIG. 1.

FIG. 14 shows a lighting fixture 50 which is also easily insertable or removable from the rigid upright members 37. It comprises a fluorescent light 52 mounted in an electrical fixture 51 which is attached to a horizontal rigid section 53*a* of bracket 53 by a screw 53*d* passed through a hole in section 53*a*. A vertical rigid section 53*b* has a hole 53*c* which permits subassembly 53 to be attached by a screw to a hole (not shown) in the rear surface of one of the vertical rigid members 37. Alternatively, another vertical leg (not shown) could be added to the underside of 53*a* parallel to leg 53*b*. It would be spaced therefrom by approximatley the thickness of the back wall of the member 37 so that the two legs could be slipped down to straddle the back wall.

In the event that not only the fronts of the panels 36, but also their backs are to be used for display purposes, another header substantially identical to header 55 could also be mounted near the rear surfaces of members 37. FIG. 15 shows a double suspending assembly 55 having a horizontal elongated rigid portion 55*a* which, toward the front, has a screw 55*d* passing through an aperture in it and holding the fixture 51 to it. Toward the rear, by means of another screw 55*d* another fluorescent fixture, which may be identical to fixture 50, is attached. The entire suspending subassembly 55 includes two vertical members 55*b* and 55*c* attached to its under surface and dimensioned to fit into the inner portion of rigid support member 37 snugly, the members 55*b* and 55*c* being located to be in close proximity to the back and front inner surfaces of the support member 37.

As shown in FIG. 16, section 32 of the overall assembly of FIG. 1 is a corner section subassembly supported principally by left, intermediate, and right upright support members 35 with two panels 36 between them. It will be noted that the left and center support members 35 of the subassembly have their smaller sides affixed to one flange of their associated panels 36. However, the right panel 36 has its left flange affixed to a larger side of the center support 35 and its right flange similarly attached to the larger side of the right support member 35.

Brackets 47 are respectively screwed or otherwise attached, either through holes in flanges or directly to the rigid members 35. They have vertical portions spaced from the support members to permit overhanging edge portions of triangular shelf 49 to rest thereon and be retained in that position. The shelves 49 can be used to hold any physical display materials, for example.

Figure 13:
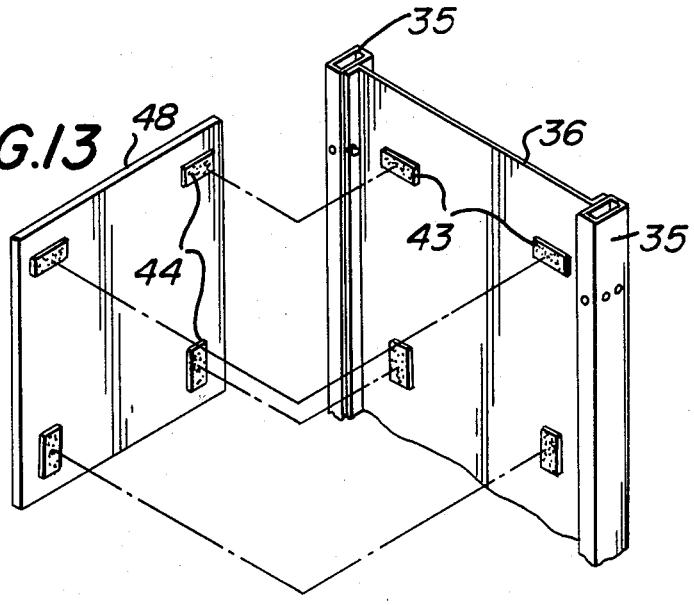
FIG. 13 is an enlarged fragmentary isometric view of a detail of the apparatus shown in FIG. 1.

FIGS. 1 and 13 also show how the corner subassembly 32 has provisions for demountably affixing signs 48, for example, on its panels 36. A number of multiple hook strips 43 of the "Velcro" brand type may be adhesively attached, for example, to the outer faces of the panels 36. A sign or board 48 has corresponding mating mesh strips 44 adhesively or otherwise attached to its inner surface so that when the sign is pressed against the corresponding hook strips 43 it is temporarily attached to the panel 35, but can easily be removed therefrom.

Figure 17:
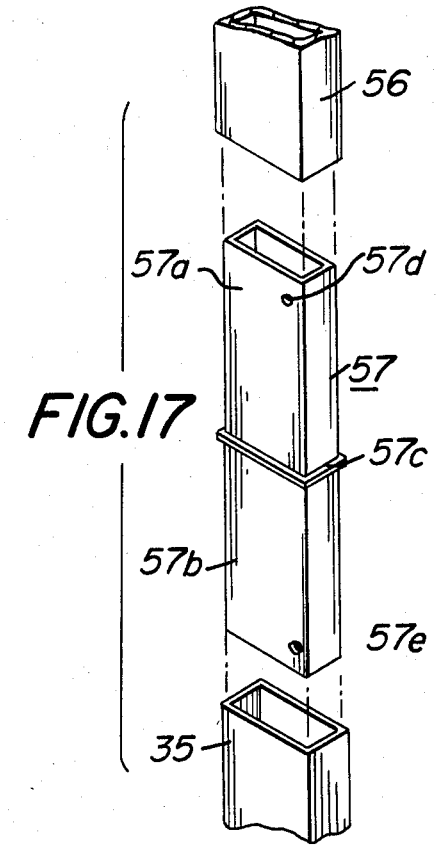
FIG. 17 is an exploded, partly sectional, fragmentary view of a detail of the structure shown in FIG. 1.

The second section 32 shows how another, quite different panel subassembly can be connected to the first and corner sections. To form a higher or second-tier panel section, a panel subassembly is formed by two support members 56 with a panel 36*e* mounted between them in the usual way. However, as shown in FIG. 17, each of the upper members 56 is joined to a lower member 35 such as the right member 35 of the corner section, by means of a junction member indicated generally at the numeral 57. Member 57 has an upper portion 57*a* with at least one threaded aperture 57*d* formed therein which can be aligned with a corresponding aperture (not shown) drilled in upright 56, the portion 57*a* being dimensioned so as to fit snugly within the lower end of upper member 56. A screw (not shown) may be screwed through the aligned apertures to retain the upper member 56 in position about and on upper portion 57*a*. Ridge 57*c* formed half-way down the member 57 acts as a stop for the lower edge of member 56 and also as a filler between the lower end of member 56 and the upper end of lower member 35.

The junction member 57 also has a lower portion 57*b* which is substantially identical to upper portion 57*a* and is so dimensioned and configured as to be able to be slid downward snugly into the upper end of lower member 35. It also has a threaded aperture 57*e* to enable it to be aligned with an aperture (not shown) in lower member 35 so that a screw can be passed into them to connect the junction to the lower member 35. It should be noted from FIG. 1 that the heights of the respective second tier panels may be selected as desired.

Turning back to FIG. 1, there is another subassembly or section 33 transverse to the plane in which upright supports 56 and 58 lie. It includes a plurality of horizontal support members 59*a*, 59*b*, 59*c*, etc. extending perpendicularly to the plane of the main panels of section 31. These support a ceiling 59*d* over section 33.

Figure 18:
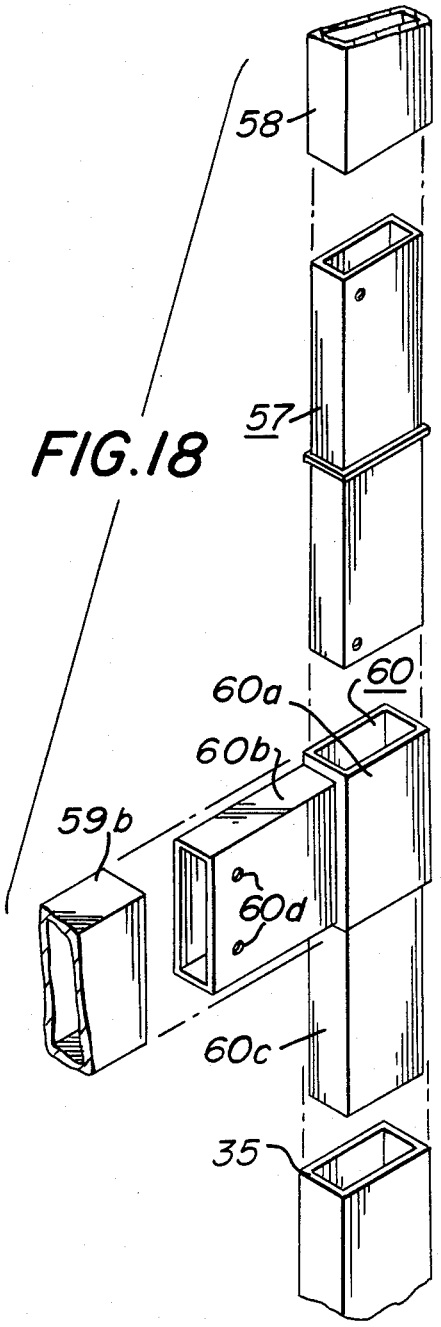
FIG. 18 is an exploded, partly, sectional, fragmentary view of a detail of the structure shown in FIG. 1.

As seen in FIGS. 1 and 18, support 59*b* as well as 59*c*, etc., but not 59*a*, are anchored at their left ends to an L-shaped junction member 60 having an intermediate portion 60*a*, a horizontal portion 60*b* and a vertical portion 60*c*. Portion 60*c* is so shaped and dimensioned that it can be inserted to fit snugly within the upper open end of lower member 35. Similarly, horizontal portion 60*b* is dimensioned and arranged to fit snugly within the left end of 59*b*. To enable the upper member 58 to be connected, another junction member 57 is inserted into the open top end of intermediate portion 60*a* which it fits snugly and to which it may be fixed by one or more lateral screws (not shown) passed through a hole (not shown) in the intermediate section. Then the lower end of the second tier upright 58 is slipped down over the upper portion of the junction member 57 down to its ridge. Screws may be inserted into appropriate aligned apertures (not shown) in members 58 and 57 for fixing them in place more securely.

Figure 19:
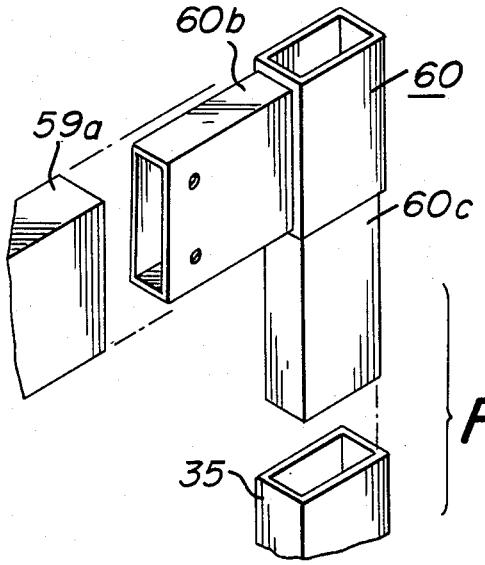
FIG. 19 is a fragmentary exploded view of another part of the invention shown in FIG. 1.

In FIG. 1, the horizontal support member 59*a* is not connected to an upper upright member, but only to an upright 35. FIG. 19 illustrates how horizontal member 59*a* is connected to upright 35 by means of the same junction member 60 shown in FIG. 18. One end of member 59*a* is slipped over the snugly fitting portion 60*b* having holes therein to engage screws passed through correspondingly aligned apertures (not shown) in member 59*a* to lock the two into position. The portion 60*c* slips down into the open end portion of the lower tier member 35 in the usual manner. If desired, additional signs 69 may be placed on the panels below member 59*a* in the same fashion as signs 48 were attached in section 32.

To enable the horizontal supports such as 59*a* to rest on the top ends of first tier uprights, there is inserted, as shown in FIG. 20, into each of their upper ends a junction member 63. Member 63 includes a first portion 63*a* which has a cross-section enabling it to fit snugly into the upper end of the upright, a ridge 63*c* and another, smaller portion 63*b* of any desired shape (here shown as having a square cross-section). Member 63*b* is designed to fit a mating aperture 62*a* formed in the lower side of the horizontal support member.

It may be desired in some constructions to erect a second tier of uprights atop a horizontal runner such as member 59*a*. For example, in the general region of the junction of 59*a* and 35*a* shown in the broken-line circle in FIG. 1, it may be desired to add an extension upright member 35*b* (atop member 59*a*) which is aligned with lower upright 35*a*. For this purpose, as illustrated in FIG. 20, the horizontal support member would have the square hole 62 formed in its upper surface. Another junction member 63, having its lower, smaller vertical portion 63*b* dimensioned to fit snugly within hole 62*b* formed in the upper surface would be inserted into member 59*a* and upright 35*b*.

FIGS. 22 and 23 illustrate an alternative construction of the header 39. Instead of using the upper and lower frame construction shown in FIGS. 8–12 which have screw connections to keep the left and right halves of the header together, the halves 73, 79 of FIGS. 22 and 23 are detachably connected by a latching subassembly which may be operated manually.

The right half (as seen in FIG. 22) upper frame member 73 comprises a J-sectioned channel member 73, with the front and rear panes 39*d* of 39*e* situated behind its front vertical wall. A C-shaped channel member 87 is positioned as shown with its vertical bight portion against the inner surface of the upper edge portion of pane 39*e*. A L-sectioned member 81 is attached to the interior of half 73 in the same position as the corresponding member 80 of left half 79 so that the two are aligned. However, the end of member 81 is set back from the left end of frame member 73 to permit the protruding right end of member 80 to penetrate its entire length within the C-shaped channel member 87.

The member 73 has a hole 73*a* cut into it into which the bent-over end 74*b* which terminates the portion 74*a* passes when the latch member 74 is pivoted counterclockwise 90° about its pivot pin 76. A friction washer 75 is used to keep latch 74 in an upright position when latching is not to take place.

The left half shown generally at numeral 79 also has a J-sectioned rigid metallic outer member 79*a*, a C-sectioned channel member for retaining panes 39*e* and 39*d* and which becomes aligned with member 87 when the halves are connected, and L-sectioned-joining member 80 lodged in member 77. Member 80 also has an aperture 80*a* formed in it which becomes aligned with aperture 73*a* when the two halves are fully joined. The members 79*b*, 77 and 80 are fixed together by rivets or other fastening means, as are their counterparts 73b, 87, and 81 in the right half.

The bottom left and right frame members substantially correspond to the top members, except there is no need for the latching mechanism including latching member 74 and apertures 73a and 80a.

What is claimed is:

1. A display system comprising:

(a) at least two rigid supporting members and (b) a selected number of generally planar panel members each having:

(1) an intermediate portion, and (2) two flange portions along respective opposite edges thereof, said flange portions extending generally perpendicular to said intermediate portion in mutually opposite directions, and (c) means for demountably connecting each planar member by its flange portions to respective ones of said rigid supporting members;

at least three of said rigid supporting members and a first of said panel members being disposed between a first and second of said rigid supporting members and a second of said panel members being disposed between said second and a third of said rigid supporting members.

2. The display system according to claim 1 wherein said first and second panel members are substantially identically disposed and identically connected to said rigid supporting members.

3. The display system according to claim 1 wherein the flanges of adjacent panels connected to the same rigid member extend in the same direction.

4. The display system according to claim 3 wherein the flange portions attached to alternate ones of said rigid members extend in the same direction.

5. The display system according to claim 1 with the addition of header means demountably attached to a predetermined number of said rigid supporting members.

6. The display system according to claim 5 wherein said rigid members are hollow and said header means includes suspending means at each end thereof which protrude into the interior of at least two of said rigid members at the tops thereof.

7. The display system according to claim 5 wherein said header means comprises light-transmitting panels.

8. The display system according to claim 5 wherein said header means comprises two coplanar parts detachably connected end-to-end.

9. The display system according to claim 8 wherein one of said parts includes at least one frame member which has a portion which projects axially therefrom and is insertable into and in contact with the other of said parts.

10. The display system according to claim 8 wherein one of said parts includes at least one frame member having a portion which projects axially therefrom and is insertable into mating contact with the interior of the other of said parts.

11. The display system according to claim 9 wherein said one frame member has a generally L-sectioned channel member and wherein said projecting portion comprises a second L-sectioned channel member fixed to said first channel member, said L-sectioned members having corresponding leg portions spaced from one another for clamping light-transmitting panels in said space and wherein said projecting portion of said one part is adapted, when inserted into said second part, to be fixed to an inner surface of said second part.

12. The display system according to claim 8 wherein said projecting portion includes a first aperture formed therein and wherein the other of said parts has a second aperture formed therein and also has latching means insertable into said apertures when aligned for preventing disengagement of said two parts.

13. The display system according to claim 10 wherein said parts also respectively include aligned C-sectioned members and L-sectioned members disposed within said C-sectioned members, said L-sectioned member of said first part being the frame member which projects axially therefrom and insertable into mating contact with the interior of said C-sectioned member of said second part.

14. The display system according to claim 7 wherein said header means also includes lighting means demountably attached to a selected one or ones of said rigid means for illuminating said light-transmitting panels.

15. A display system comprising:

(a) at least two rigid supporting members and (b) a selected number of generally planar panel members each having:

(1) an intermediate portion, and (2) two flange portions along respective opposite edges thereof, said flange portions extending generally perpendicular to said intermediate portion in mutually opposite directions, and (c) means for demountably connecting each planar member by its flange portions to respective ones of said rigid supporting members;

a third rigid supporting member disposed coaxially on top of at least one of said two rigid supporting members by means of a junction member.

16. The display system according to claim 15 wherein said coaxially arranged rigid supporting members are hollow and wherein said junction member has a lower portion which fits in the top end of the lower coaxial rigid means and a second portion which fits in the lower end of the upper coaxial rigid member.

17. The display system according to claim 15 wherein said junction member is shaped and dimensioned to fit snugly into said top and lower ends of said coaxially arranged rigid members and also has a ridge between its upper and lower portions.

* * * * *